US007052241B2

(12) United States Patent
Decker

(10) Patent No.: US 7,052,241 B2
(45) Date of Patent: May 30, 2006

(54) METAL INJECTION MOLDED TURBINE ROTOR AND METAL SHAFT CONNECTION ATTACHMENT THERETO

(75) Inventor: David M. Decker, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 153 days.

(21) Appl. No.: 10/639,256

(22) Filed: Aug. 12, 2003

(65) Prior Publication Data

US 2005/0036893 A1 Feb. 17, 2005

(51) Int. Cl.
*F01D 25/00* (2006.01)

(52) U.S. Cl. ..... 416/213 R; 416/244 A; 419/8; 428/553

(58) Field of Classification Search ..... 416/213 R, 416/244 A; 29/899.2; 419/5, 8, 9; 428/553
See application file for complete search history.

(56) References Cited

U.S. PATENT DOCUMENTS 4,784,574 A * 11/1988 Tsuno et al. ..... 416/241 B
5,084,329 A * 1/1992 Kato et al. ..... 428/212
5,106,550 A * 4/1992 Yogo et al. ..... 156/89.11
5,431,752 A * 7/1995 Brogle et al. ..... 148/516
5,482,437 A * 1/1996 Houston et al. ..... 416/244 A
6,291,086 B1 * 9/2001 Nguyen-Dinh ..... 428/660
6,375,710 B1 * 4/2002 Moore et al. ..... 75/252

* cited by examiner

*Primary Examiner*—Ninh H. Nguyen
(74) *Attorney, Agent, or Firm*—Pendorf & Cutliff; Greg Dziegielewski

(57) ABSTRACT

A rotor shaft assembly (101) of a type used in a turbocharger, manufactured by mounting a powder compact (203) of a titanium aluminide rotor (103) to a pre-formed steel shaft (107), and sintering the combination, which provides a strong metallurgical bond between the shaft (107) and rotor (103). There is provided a rotor shaft assembly (101) and an inexpensive and efficient method of its manufacture, for an assembly capable of withstanding the high forces and fluctuating temperatures within a turbocharger.

10 Claims, 3 Drawing Sheets

METAL INJECTION MOLDED TURBINE ROTOR AND METAL SHAFT CONNECTION ATTACHMENT THERETO

FIELD OF THE INVENTION

The present invention relates to a rotor shaft assembly of a type used in an exhaust driven turbocharger to drive a compressor and provide compressed air to an internal combustion engine, and to a method for the manufacture of the rotor shaft assembly. Specifically, the invention relates to a rotor shaft assembly for a turbocharger comprising a titanium aluminide turbine rotor axially jointed to a steel shaft by a metallurgical bond, and to a method for its manufacture. More specifically, the invention relates to a novel method for the axial attachment of a titanium aluminide turbine rotor to a steel shaft by the sintering of a powder compact of a rotor mounted to a preformed shaft.

DESCRIPTION OF THE RELATED ART

Turbochargers are widely used in internal combustion engines to increase engine power and efficiency, particularly in the large diesel engines of highway trucks and marine engines. Recently, turbochargers have become increasingly popular for use in smaller, passenger car engines. A turbocharger enables a power plant to develop a certain number of horsepower from a lighter engine. The use of a lighter engine has the desirable effect of decreasing the mass of the car, thus enhancing fuel economy and increasing sports performance. In addition, the use of a turbocharger permits more complete combustion of the fuel delivered to the engine, which reduces hydrocarbon and NOx emissions, thereby contributing to the highly desirable goal of a cleaner atmosphere.

Turbochargers generally comprise a turbine housing that directs exhaust gases from an exhaust inlet to an exhaust outlet across a turbine rotor. The turbine rotor drives a shaft, which is journaled in a bearing housing section. A compressor rotor is driven on the other, or distal, end of the shaft to provide pressurized gas to the engine inlet.

The general design and function of turbochargers are described in detail in the prior art, for example, U.S. Pat. Nos. 4,705,463, 5,399,064, and 6,164,931, the disclosures of which are incorporated herein in their respective entireties by reference.

To improve the heat resistance of the turbocharger, and to improve the responsiveness of the engine to changing operating conditions, it is preferred to minimize the inertia of the turbine rotor. Low inertia ceramic turbine rotors made of silicon nitride are known in the art. However, ceramic turbine rotors have drawbacks: silicon nitride rotors must be thicker than metal rotors because of the lower toughness of ceramics. Also, it is difficult to balance the thermal expansion of the rotor and its metal casing to maintain required clearances because of the much lower thermal expansivity of ceramics compared to most metals.

Titanium aluminide (TiAl) is preferable to ceramic as a material for the manufacture of turbine rotors because it combines a low specific gravity of approximately 3.8; a high specific strength (strength by density) at high temperatures, which is equal to or better than that of Inconel 713° C.; with a thermal expansion coefficient close to that of other metals. For at least these reasons, TiAl is known in the art for the manufacture of turbine rotors (see e.g., Japanese Patent Disclosure No. 61-229901, and U.S. Pat. Nos. 6,007,301, 5,064,112, 6,291,086, and 5,314,106). Titanium alloys are also known for use in turbine rotors, including those comprising a TiAl intermetallic compound as the main component, and also TiAl alloys containing non-titanium elements in lesser amounts. In the following description, all such alloys are referred to as TiAl. (Where the term "TiAl" herein refers specifically to a chemical formula denoting a 1:1 stoichiometric combination of titanium and aluminum, this is noted.) Both because of expense, and to minimize the inertia of the rotor, TiAl rotors are preferably manufactured from the minimum of material.

Increasingly, powder metal processes are used to manufacture rotors and other parts having complex geometries. In these processes, metal injection molding of a metal powder admixed with a binder produces a powder compact, which is debound (by low temperature and/or solvent treatment) and sintered (at high temperature) to yield a near-net part that may be finished by conventional means. These processes provide for inexpensive high-volume production, and may be used to manufacture both the rotor and shaft of a turbine rotor assembly. See, U.S. Pat. No. 6,478,842 to Gressel et al. A further level of sophistication can be achieved by metal injection molding components with different metal powders injected into different parts of the mold. See U.S. Patent Pub. No. US2003/0012677 to Senini. Technical constraints upon the size of metal injection molded parts (approximately 250 g) have precluded the application of this method to produce a bimetallic turbine rotor assembly comprising a TiAl turbine rotor and a steel shaft.

To manufacture a turbine rotor assembly comprising a TiAl turbine rotor and a steel shaft, the rotor must therefore be bonded to the shaft. In the case of turbine rotors made of the well-known Ni-based superalloy, Inconel 713° C., a suitably strong bond between shaft and rotor is rather easily achieved by friction welding or electron-beam welding.

In contrast, achieving a suitably strong bond between TiAl and a steel shaft is very difficult and this has limited the use of TiAl rotors in production because of the additional expense and steps required. Direct friction welding is ineffective for mounting a TiAl turbine rotor to a steel shaft because transformation of the structural steel from austenite to martensite when the shaft steel is cooled causes a volume expansion of the steel, which results in high residual stresses at the joint. This difficulty is compounded by the large difference between the melting points of steel and TiAl, and the very different metallurgy of the two alloys. Even though TiAl has high rigidity, its ductility at room temperature is low (about 1%), and so TiAl rotors readily crack due to residual stresses. In addition, during heating and cooling, titanium reacts with carbon in steel to form titanium carbide at the bonding interface, resulting in a weaker bond.

Securely attaching a TiAl rotor to a steel shaft, or to any metallic shaft, is also difficult because the bond must be able to withstand the severe elevated and fluctuating temperatures that are found within an operating turbocharger. The bond must also withstand high circumferential loads due to centrifugal forces and forces due to high and fluctuating torques. It has therefore proved almost impossible to provide a particularly positive, intimate joint to connect a TiAl rotor to a steel shaft, without interposing a third material of different composition.

To connect a TiAl rotor to a steel shaft it is known to interpose an austenitic material that does not suffer from martensitic transformation. A first bond, typically a weld, is required between the interposed material and the turbine rotor, and a second bond, also typically a weld, is required to attach the rotor to the shaft via the interposed material.

These extra steps add time and expense to the manufacture of a turbine rotor assembly. Furthermore, controlling the final thickness of the interposed material is difficult.

As one example, U.S. Pat. No. 5,431,752 to Brogle et al. discloses a nickel alloy piece interposed between a γ-TiAl rotor and a steel shaft, in which the interposed piece is sequentially bonded to the shaft and rotor by friction welding.

As a second example, U.S. Pat. No. 5,064,112 to Isobe et al. discloses the use of an austenitic stainless steel, or a Ni-based or Co-based superalloy, interposed between a structural steel and a TiAl member to achieve a strong friction weld.

As a third example, U.S. Pat. No. 6,291,086 to Nguyen-Dinh teaches an intermediate iron-based interlayer to attach steel and TiAl members.

As a fourth example, U.S. Pat. No. 5,3114,106 to Ambroziak et al. provides two thin intermediate layers of copper and vanadium to attach steel and TiAl members, respectively. All four of the above examples suffer from the significant drawbacks of requiring additional steps, additional expense, and providing degraded dimensional stability.

It is also known to vacuum braze a TiAl rotor to a steel shaft, as disclosed in Japanese Patent Disclosure No. 02-133183. However, this method suffers from the drawback that the brazing must be performed under a high vacuum, which is time consuming and expensive. In addition, achieving a reliable strong bond by this method may be problematic.

Shrink-fitting is known for the attachment of a ceramic rotor to a steel shaft. U.S. Pat. No. 5,174,733 to Yoshikawa et al. teaches attachment of a ceramic rotor having an axial projection to a shaft having an axial cup-shaped receptacle at one end to accept the projection. The inner diameter of the cup-shaped receptacle is about 50 μm smaller than the diameter of the projection, and the greater thermal expansivity of the metal shaft compared to the ceramic rotor produces a strong shrinkage fit between the rotor and shaft when mounted. However, this method is not adaptable to attach a TiAl rotor directly to a steel shaft because, particularly at low temperatures (below about 700° C.), TiAl is brittle and the surface pressure required to achieve a sufficiently strong bond would crack the rotor by exceeding TiAl's yield point. This problem is exacerbated with large rotors, which require higher surface pressures to achieve a stable bond.

Even for rotors comprising the more ductile rotor material, aluminum, shrink fitting to a steel shaft is difficult. To lower the surface pressure that is applied directly to the rotor by shaft, and thereby to reduce cracking, U.S. Pat. No. 3,019,039 teaches a sleeve that is interposed between the rotor and the shaft, in which the sleeve is composed of a material having a thermal expansivity intermediate between that of the rotor and the shaft. The additional steps, the extra sleeve, the requirement of the shrink-fitting method for close tolerances in all three parts, and the associated additional labor expense, all mitigate against the use of this method to mount a TiAl rotor to a steel shaft.

There is therefore a need for a method to attach a TiAl rotor to a steel shaft for the economical manufacture of a strong and dimensionally stable rotor shaft assembly. The bond between the rotor and shaft must be sufficiently strong to withstand high fluctuating torques and temperatures, and is preferably formed by a method requiring the minimum of steps and expense. The present invention provides these advantages and more, as will become apparent to one of ordinary skill upon reading the following disclosure and figures.

SUMMARY OF THE INVENTION

In a broad aspect, the invention seeks to overcome the disadvantages of the aforementioned prior art and provide a rotor shaft assembly having a strong bond between a TiAl turbine rotor and a steel shaft. The invention provides an intimate positive union of the rotor and shaft by a metallurgical bond that is capable of withstanding the high and fluctuating temperatures found in an operating turbocharger. Furthermore, the invention provides a metallurgical bond that is sustained despite the high centrifugal forces encountered at the jointing surface of the rotor and shaft, and is suitable for transmitting relatively high shaft torque.

In accordance with a first embodiment of the invention, there is provided a rotor shaft assembly of a type used in a turbocharger for rotating about its axis to drive a compressor and supply compressed air to an internal combustion engine. The rotor shaft assembly has at least two parts bonded together by a metallurgical bond. The rotor shaft comprises a steel shaft, which is preferably a stainless steel shaft. The TiAl rotor is provided with a central hub that is adapted in its shape to accept the proximal end of the shaft in an axial manner and the shaft of the rotor shaft assembly is axially mounted to the hub of the rotor thereby providing a common rotational axis for the shaft and rotor. The turbine rotor is bonded to the proximal end of the shaft by a strong metallurgical bond formed during sintering of a powder compact of the rotor axially mounted to a finished, or alternatively a near-net, shaft.

In accordance with a second embodiment of the invention, there is provided a process for the efficient axial bonding of a steel shaft to the hub of a TiAl rotor of a turbine rotor assembly. In a first step, the proximal end of a steel shaft is mounted in an axial position to the hub of a powder compact of a TiAl rotor. The compact comprises a TiAl powder admixed with a binder, and the binder and amount thereof is selected to provide a pre-determined amount of shrinkage of the compact during a sintering step. During the sintering step, the shrinkage of the hub establishes and maintains a high surface pressure of the hub on the shaft, resulting in the formation of a strong metallurgical bond comprising at least a solid state diffusional component, and optionally a fusion component, depending upon the sintering conditions.

In a third embodiment, the rotor is adapted to receive the shaft within an axial pocket disposed within the hub of said rotor, and one or more substantially enclosed axial air pockets are provided between the shaft and the rotor in the mounted position. The one or more axial pockets advantageously minimize heat transfer from the rotor to the shaft during operation of the turbocharger.

The turbine rotor assembly of the present invention is optionally machine finished to enhance dimensional accuracy, balance, and/or surface finish, by techniques that are well known to those of ordinary skill in the art.

BRIEF DESCRIPTION OF THE DRAWINGS

A more complete appreciation of the invention and many of the attendant advantages thereof will be readily obtained by reference to the following detailed description when considered in connection with the accompanying drawings, wherein.

DETAILED DESCRIPTION OF THE INVENTION

Figure 1:
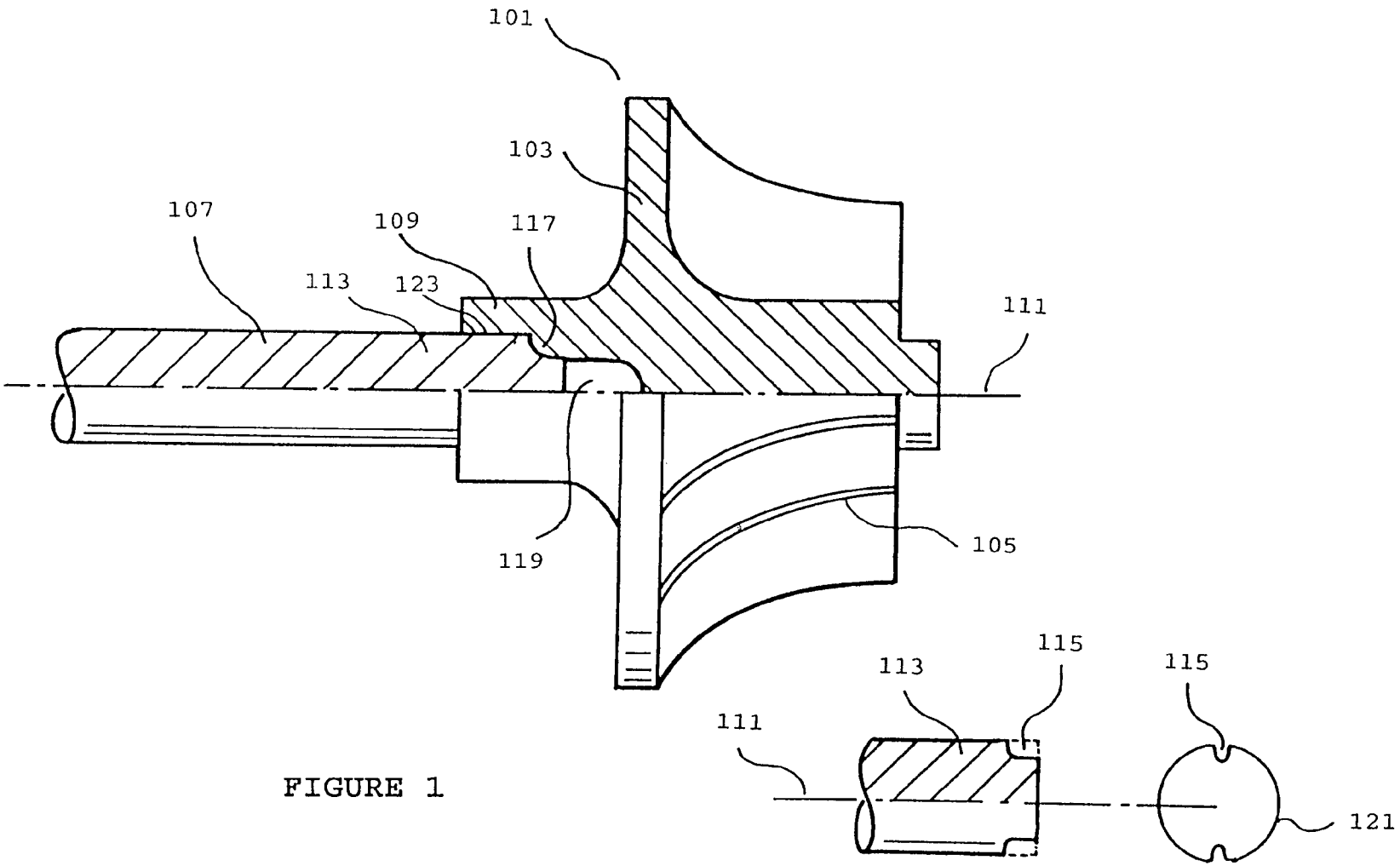
FIG. 1 shows a diagrammatic cross-section of the rotor shaft assembly of one embodiment of the present invention, and axial and longitudinal cross-sections of the proximal end of a shaft embodiment provided with an optional local notch.

A basic embodiment of the rotor shaft assembly of the present invention is shown in FIG. 1. The rotor shaft assembly 101 comprises a TiAl rotor 103, which comprises a plurality of vanes 105. The TiAl rotor 103 comprises a hub 109 disposed about the common axis of rotation 111 of the rotor shaft assembly. The interior surface 123 of the hub 109 is in intimate and positive connection with the proximal end 113 of metallic shaft 107. The hub 109 of rotor 103 is adapted for axial engagement of the proximal end 113 of steel shaft 107. In the specific embodiment of FIG. 1, the proximal end 113 of steel shaft 107 comprises a plurality of local notches 115, disposed radially, and preferably equidistantly, about the circumference 121 of the proximal end 113 of the steel shaft 107. In the mounted configuration, the local notches 115 engage corresponding lugs 117 within the hub 109 of the rotor 103.

Optionally, one or more cavity 119 is provided disposed between the interior surface of the hub 123 of rotor 103 and the surface of the proximal end 113 of the shaft 107. The cavity or cavities advantageously minimize heat transfer from the rotor, which is exposed to hot exhaust gases, to the shaft and its bearing.

The metal injection molded and sintered articles of the present invention are prepared by injection molding an admixture of metal particles in a binder. Parts prepared by injection molding an admixture of metal particles in a binder, but prior to debinding or sintering, are herein termed "compacts." Compacts are subjected to debinding and sintering steps, to remove binder and to increase metallic density, respectively, as is known in the art. Thus, the compact of a TiAl rotor, or a "rotor compact," is prepared by injection molding an admixture of TiAl particles and a binder. The TiAl intermetallic compound that is used is selected to be capable, in the finished compacted form of withstanding the temperatures and stresses in an operating turbocharger, and resisting corrosion, but is not otherwise limited.

Although single phases of the specific compounds TiAl ("TiAl" is specifically used here in the sense of a chemical formula, as distinct from the use of the term herein elsewhere to denote titanium alloys comprising a TiAl intermetallic compound) and $Ti_3Al$ are brittle and weak, two-phase intermetallic TiAl is formed when aluminum comprises about 31–35% of the material by weight and Ti comprises substantially all of the remaining mass. The two-phase TiAl exhibits good ductility and strength, particularly at elevated temperatures.

Other metals are advantageously included in the TiAl metal powder used to injection mold the compact of the rotor of the present invention. Minor amounts of Cr, Mn, and V improve ductility, within the range of about 0.2% to about 4%. At amounts greater than about 4%, oxidation resistance and high temperature strength may be compromised. Ni, Ta, and W typically improve the oxidation resistance of TiAl. Si, in amounts between about 0.01% to about 1% improves creep and oxidation resistance. Suitable TiAl materials for use in the present invention include, but are not limited to, those disclosed in U.S. Pat. Nos. 5,064,112 and 5,296,055, US Publication No. 2001/0022946 A1, and U.S. Pat. No. 6,145,414.

The TiAl used to prepare the rotor compact is in the form of a micron-sized powder having a particle size of from about 1 μm to 40 μm. Preferably the particle size is between about 1 μm and 10 μm. Methods for the production of fine powdered metals having a particle size of less than about 10 μm are known in the art, for example by plasma discharge spheroidization (Mer Corp.).

The TiAl powder is admixed with a binder for injection molding. The binder can be selected from among a wide variety of known binder materials, including, but not limited to, waxes, polyolefins such as polyethylenes and polypropylenes, polystyrenes, polyvinyl chloride, polyethylene carbonate, polyethylene glycol and microcrystalline wax. Aqueous binder systems of the type described in U.S. Pat. No. 5,332,537, and agar-based binders as described in U.S. Pat. Nos. 4,734,237, 5,985,208 and 5,258,155, are also suitable. The particular binder will be selected for its comparability with the powder metal, ease of mixing, molding properties, and its propensity to form deleterious titanium carbide by the reaction of the binder's thermal decomposition products with titanium. Thermoplastic binders are preferred.

An additional consideration in the selection of the binder will be the degree of shrinkage of the rotor compact required during sintering. Typically, about 15% shrinkage is obtained during the sintering of a TiAl compact. However, the degree of shrinkage can be predetermined by the choice of binder, the ratio of binder to TiAl powder in the admixture, and the selection of debinding or sintering conditions. U.S. Pat. No. 5,554,338 to Sugihara et al., the disclosure of which is incorporated herein by reference, discloses binders suitable for the preparation of an outer compact of a composite body, such that a tight fit of the compact to an inner body and a large contact area is ensured by the predetermined choice of the shrinkages of the outer compact.

A further consideration in the selection of the binder is to avoid the use of any binder having a propensity to react with the titanium of the TiAl powder to form titanium carbide under debinding or sintering conditions. Titanium carbide may weaken jointing with the shaft.

Nothing herein should be construed to limit the rotor or shaft of the rotor shaft assembly of the present invention to rotors or shafts having a homogenous metal composition. Bi-metallic metal injection molding is known (see e.g., U.S. Patent Application Publication No. US 2003/0012677 A1) wherein different metallic powder compositions admixed to binders are positioned in different portions of a mold to produce articles having a heterogenous metal distribution. Such methods are fully adaptable to the process and assembly of the present invention.

In contrast to the rotor, the shaft of the rotor shaft assembly of the present invention is prepared in near-net form by any method known in the art, including but not limited to, machining, forging, hot isostatic pressing, metal injection molding, casting, and the like. The steel of the powder is not particularly limited except that it should have tensile strength and corrosion resistance commensurate with providing adequate service within a turbocharger. Stainless steel alloys, comprising iron and at least one other component to impart corrosion resistant, are preferred. Alloying metals can include at least one of chromium, nickel, silicon, and molybdenum. Suitable steels include precipitation hardened stainless steels such as 17-4 PH stainless steel, which is an alloy of iron, 17% chromium, 4% nickel, 4% copper, and 0.3% niobium and tantalum, which has been subjected to precipitation hardening. Medium carbon steels, such as 4140, are preferred.

The TiAl rotor compact comprises a central hub adapted to accept a portion of the proximal end of the shaft. The means by which the hub is adapted to mount the shaft is not particularly limited, except that it is required that, when mounted, the entire circumferential surface of at least a portion of the proximal end of the shaft should be enclosed with the hub so that shrinkage of the hub and rotor during sintering applies a substantial surface pressure to the preformed shaft at the jointing surface to promote formation of a metallurgical bond. The fit of the hub compact to the shaft is predetermined according to various factors. Compacts have low tensile strength, which precludes interference fitting. By selecting the metal powder particle size and composition, binder, and debinding and sintering conditions, according to principles known in the art, one of skill in the art can easily predetermine the rate and extent of shrinkage of the rotor compact during sintering. See U.S. Pat. No. 5,554,338 to Sugihara et al. In particular, by predetermining the shrinkage and rate of shrinkage of the rotor compact, a close fit is provided between the shaft and rotor during sintering sufficient to promote formation of a strong metallurgical bond. These considerations inform the dimensions of the shaft and the dimensions of the rotor mold. Preferably, the fit of the compact to the shaft should be a sliding or push fit such that the rotor can be mounted with the minimum of clearance between the fitted parts, but without stressing the rotor compact. Where a compact that exhibits a high degree of shrinkage is used, additional clearance between the shaft and hub may be required to prevent distortion of the hub relative to the rest of the rotor during sintering.

The present inventors have surprisingly found that by predetermining the shrinkage rate and shrinkage extent of the rotor compact to effect a continuous and tight fit of the shaft and rotor hub during sintering, a bond of sufficient strength can be achieved between the dissimilar materials of a TiAl rotor and steel shaft of a turbocharger rotor shaft assembly.

Figure 2:
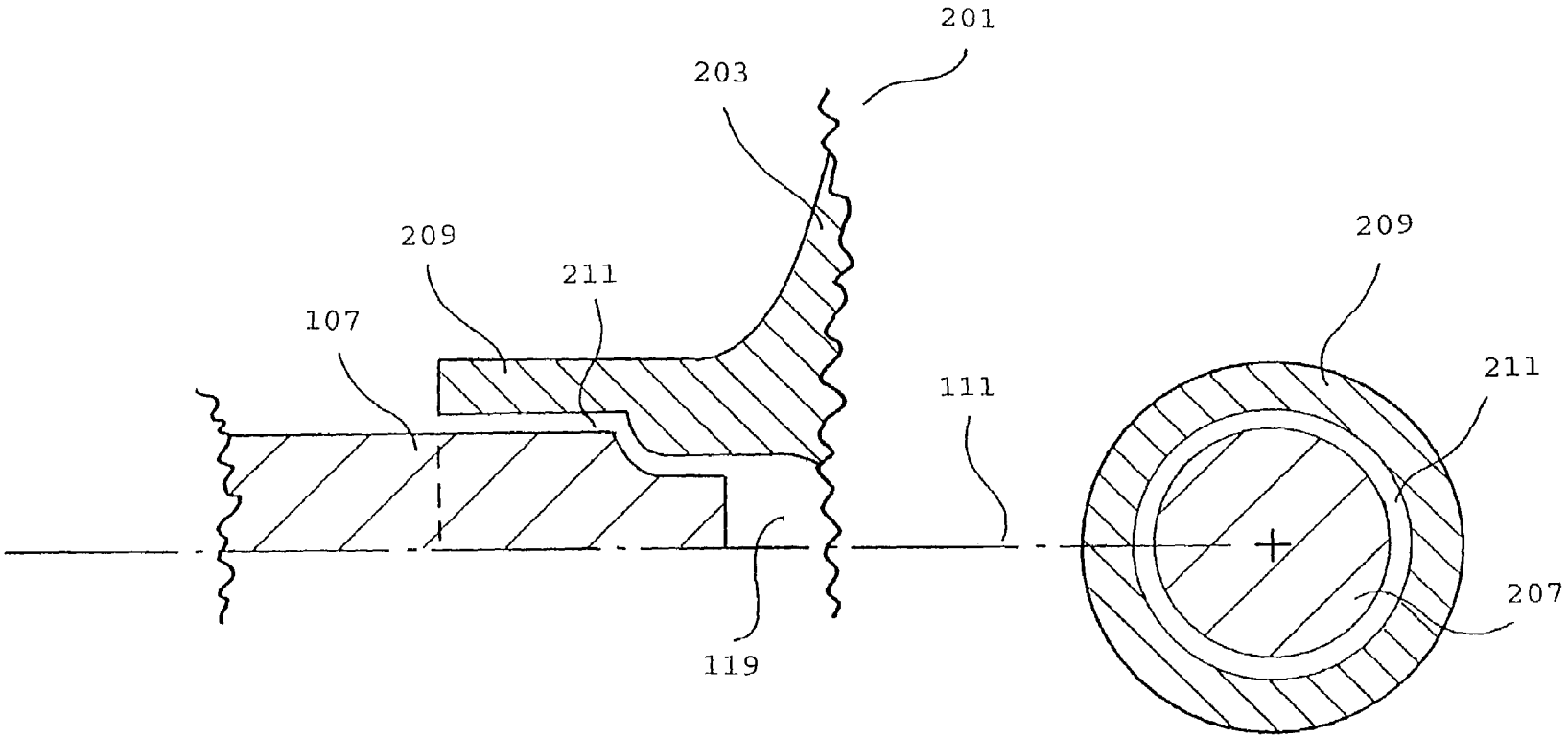
FIG. 2 shows axial and transverse cross sections of the jointing surfaces of the proximal end of the shaft mounted to the hub of the rotor prior to sintering.

Referring now to FIG. 2, there is shown an unsintered assembly 201 comprising a rotor compact 203 and a preformed steel shaft 107. Specifically, there is shown a cross section of the jointing surfaces of the proximal end of the pre-formed shaft 107 mounted to the hub 209 of the rotor compact 203 prior to sintering. The proximal end of the steel shaft 107 is axially mounted along rotational axis 111 to the hub 209 of the rotor compact. Optionally, a clearance 211 is provided between the preformed shaft 107 and the inner surface of the hub 209. The clearance is chosen to avoid distortion of the hub relative to the shaft upon sintering, while still maintaining a close contact between the shaft and hub during sintering. The close contact promotes bonding by increasing local contacts.

The fine particles of the rotor compact are known to undergo solid-state diffusion at the jointing surface, which presumably promotes local bonding at contact points. Therefore, fine powders are preferred because of their high surface energy and high diffusivity, properties that promote the formation of a diffusion bond during sintering. At high sintering temperatures, fusion bonding is presumed to also contribute to bonding due to the formation of local liquid phase at the bonding surface.

Thus, the metallurgical bond is presumed to comprise contributions from solid-state diffusion bonding, and, where some liquid phase of the metals occurs, fusion bonding, and the term "metallurgical bond," as used herein, has that meaning. See U.S. Pat. No. 6,551,551 to Gegel and Ott.

After mounting of the rotor compact and shaft, the mounted compact is debound to remove binder. The product of debinding is termed a "brown" rotor shaft assembly. Debinding is typically carried out at a temperature of less than about 300° C. that is sufficient to decompose and remove substantially all the binder. Preferably, the debinding temperature is between about 200° C. and 250° C. A solvent, including water, can be used to debind at lower temperatures, the solvent being appropriate to the binder.

Sintering of the brown rotor shaft assembly is typically carried out at a temperature from about 1200° C. to about 1430° C. for a period from about 45 min to about 2 hours. The specific sintering conditions depend upon the specific binders used, the TiAl alloy, and the shape and size of the sintered object. Preferably, to minimize oxidation, the sintering is performed in a partial vacuum or under at least a 50% hydrogen atmosphere. Most preferably, sintering is performed under a 90% hydrogen atmosphere. While nitrogen and argon also minimize oxidation, hydrogen is known to improve densification.

The sintering process yields a jointed rotor shaft assembly in near-net form. Typically, additional finishing processes, which are well known to those of ordinary skill in the art, are preferred. The rotor shaft assembly can be machined, for example to improve the balance of the assembly for high-speed operation, or the surface may be improved by any of a number of techniques, such as ball-peening and the like.

Figure 3:
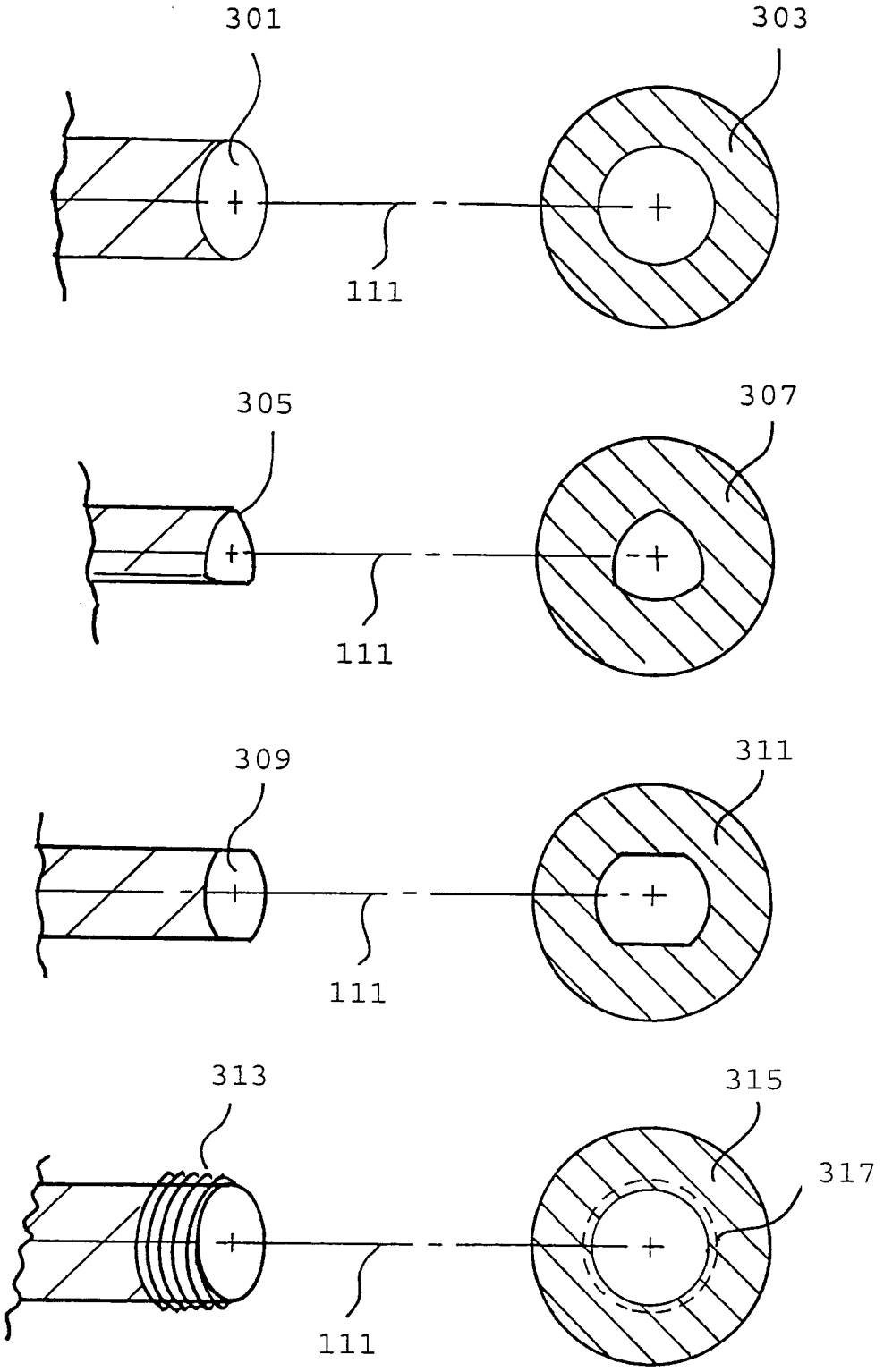
FIG. 3 shows cross-sections of four exemplary proximal shaft ends for mounting to rotor hubs adapted to their respective shafts.

Referring now to FIG. 3, there are shown several cross-sections of optional proximal shaft ends for mounting to turbine rotors similarly adapted to their respective shafts. The means to adapt the hub to the proximal end of the shaft is not limited, except to provide adequate bonding surface, and to maintain the balance of the rotor shaft assembly for high-speed stability. Thus, inherently balanced shaft end shapes having a high degree of symmetry are preferred. While a cylindrical proximal end to the shaft can be used, a stronger resistance to separation of the rotor from the shaft can be achieved by the use of a proximal shaft end shape that hinders independent rotation of the shaft and rotor. Preferably, the proximal end of the shaft is polygonal, a flatted shaft, comprises a local notch, or has a threaded shaft. These, and other, means to adapt the hub of the rotor to mount a suitably adapted shaft, within the design constraints of a particular application, to produce a balanced rotor shaft assembly having hindered independent rotation of the shaft and rotor, will be readily apparent to those of skill in the art.

Various modifications and changes may be made by those having ordinary skill in the art without departing from the spirit and scope of this invention. Therefore, it is to be understood that the illustrated embodiments of the present invention have been set forth only for the purposes of example, and that they should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements that are literally set forth, but all equivalent structure material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Now that the invention has been described,

What is claimed is:

1. A process for axially bonding the hub (109) of a titanium aluminide (TiAl) turbine rotor (103) to a preformed steel shaft (107) of a rotor shaft assembly (101) of a type used in a turbocharger for rotating about its axis (111) to drive a compressor, said process comprising:

(a) axially mounting a preformed steel shaft (107), to the hub (209) of a compact (203) of said rotor (103), wherein said compact comprises a TiAl powder admixed with a binder, to form a mounted compact (201) optionally comprising a clearance (211) between said hub (209) of said compact (203) and said shaft (107), and (b) debinding and sintering said mounted compact (201), wherein said rotor compact (203) and said clearance (211) are selected to provide a tight fit of said hub (209) to said shaft (107) during sintering, whereby said rotor (103) and said shaft (107) are bonded by metallurgical bonding to form said rotor shaft assembly (101).

2. The process of claim 1, wherein said binder is selected from the group consisting of waxes, polyolefin, polyethylene, polypropylene, polystyrene, polyvinyl chloride, polyethylene carbonate, polyethylene glycol, and microcrystalline wax, or a mixture thereof.

3. The process of claim 1, wherein said debinding is carried out at temperature of between about 200° C. and 250° C.

4. A rotor shaft assembly (101) prepared according to the process of claim 1.

5. The rotor shaft assembly (101) of claim 4, in which said shaft (107) comprises stainless steel.

6. The rotor shaft assembly (101) of claim 4, in which the proximal end of said shaft (107) has a shape selected from the group consisting of a knurled shaft (301), a polygonal shaft (305), a flatted shaft (309), a threaded shaft (313), and a notched shaft (107).

7. A process for axially bonding the hub (109) of a titanium aluminide (TiAl) turbine rotor (103) to a preformed steel shaft (107) of a rotor shaft assembly (101) of a type used in a turbocharger for rotating about its axis (111) to drive a compressor, said process comprising:

(a) axially mounting a preformed steel shaft (107), to the hub (209) of a compact (203) of said rotor (103), wherein said compact comprises a TiAl powder admixed with a binder, to form a mounted compact (201) optionally comprising a clearance (211) between said hub (209) of said compact (203) and said shaft (107), and (b) debinding and sintering said mounted compact (201), wherein said rotor compact (203) and said clearance (211) are selected to provide a tight fit of said hub (209) to said shaft (107) during sintering, whereby said rotor (103) and said shaft (107) are bonded to form said rotor shaft assembly (101), and wherein said sintering is performed from about 1200° C. to about 1430° C. for a period from about 45 mm to about 2 hours.

8. A process for axially bonding the hub (109) of a titanium aluminide (TiAl) turbine rotor (103) to a preformed steel shaft (107) of a rotor shaft assembly (101) of a type used in a turbocharger for rotating about its axis (111) to drive a compressor, said process comprising:

(a) axially mounting a preformed steel shaft (107), to the hub (209) of a compact (203) of said rotor (103), wherein said compact comprises a TiAl powder admixed with a binder, to form a mounted compact (201) optionally comprising a clearance (211) between said hub (209) of said compact (203) and said shaft (107), and (b) debinding and sintering said mounted compact (201), wherein said rotor compact (203) and said clearance (211) are selected to provide a tight fit of said hub (209) to said shaft (107) during sintering, whereby said rotor (103) and said shaft (107) are bonded to form said rotor shaft assembly (101), and wherein said powders have a particle size of from about 1 μm to 40 μm.

9. The process of claim 8, wherein said powders have a particle size of from about 1 μm to 10 μm.

10. The rotor shaft assembly (101) prepared by a-process for axially bonding the hub (109) of a titanium aluminide (TiAl) turbine rotor (103) to a pre-formed steel shaft (107) of a rotor shaft assembly (101) of a type used in a turbocharger for rotating about its axis (111) to drive a compressor, said process comprising:

(a) axially mounting a preformed steel shaft (107), to the hub (209) of a compact (203) of said rotor (103), wherein said compact comprises a TiAl powder admixed with a binder, to form a mounted compact (201) optionally comprising a clearance (211) between said hub (209) of said compact (203) and said shaft (107), and (b) debinding and sintering said mounted compact (201), wherein said rotor compact (203) and said clearance (211) are selected to provide a tight fit of said hub (209) to said shaft (107) during sintering, whereby said rotor (103) and said shaft (107) are bonded to form said rotor shaft assembly (101), said rotor shaft assembly (101) further comprising one or more cavities (119) disposed between the proximal end (113) of said shaft (107) and said hub (109).

* * * * *